United States Patent [19]

Koh

[11] Patent Number: 4,567,058

[45] Date of Patent: Jan. 28, 1986

[54] METHOD FOR CONTROLLING LATERAL DIFFUSION OF SILICON IN A SELF-ALIGNED $TISI_2$ PROCESS

[75] Inventor: Yun B. Koh, Sunnyvale, Calif.

[73] Assignee: Fairchild Camera & Instrument Corporation, Mountain View, Calif.

[21] Appl. No.: 634,937

[22] Filed: Jul. 27, 1984

[51] Int. Cl.[4] ..... B05D 3/06; B05D 5/12; B44C 1/22; C03C 15/00

[52] U.S. Cl. ..... 427/55; 156/643; 156/662; 427/93; 427/399

[58] Field of Search ..... 427/53.1, 55, 87, 93, 427/399; 156/643, 662

[56] References Cited

PUBLICATIONS

Wahl, G. et al, *The CVD Deposition of Ti-Si Containing Coating on Ni-Base Super Alloys,* pp. 685-698, Electrochemical Society, N.J., 1981.

Shibata, T. et al., *Metal Silicon Reactions Induced by CW Scanned Laser and Electron Beams,* Stanford Electronic Laboratory, Mar. 1981, pp. 637-644.

*Primary Examiner*—Michael R. Lusignan

*Attorney, Agent, or Firm*—Townsend and Townsend

[57] ABSTRACT

An improved method for forming a titanium silicide layer comprising placing a silicon layer overcoated with titanium in an ambient atmosphere of ultrapure nitrogen and heating the overcoated layer with radiation from a tungsten-halogen source.

18 Claims, 8 Drawing Figures

METHOD FOR CONTROLLING LATERAL DIFFUSION OF SILICON IN A SELF-ALIGNED $TiSi_2$ PROCESS

BACKGROUND OF THE INVENTION

1. Field of the Invention

The present invention relates generally to semiconductor processing, and more particularly to preventing lateral diffusion of silicon during the formation of a titanium silicide layer.

2. Description of the Prior Art

An important technique for reducing the scale of monolithic semiconductor structures to two micrometers is a self-aligned titanium silicide process.

In this process, titanium silicide is formed on the upper surface of a polycrystalline silicon (poly) line to dramatically increase the conductivity of the poly line and to obviate the need for an extra masking step to form metal contacts. These lines are generally formed over a field oxide layer formed on the upper surface of a monocrystalline silicon substrate. A pair of poly lines may terminate on the exposed surface of the substrate with a small gap formed between the terminal ends of the lines.

Often it is necessary to prevent titanium silicide formation over selected regions of exposed silicon. A passivating oxide layer is formed over these selected regions and utilized to prevent titanium silicide formation.

For example, a resistor, diode, or other active device may be formed in a region of a poly line. If the titanium silicide layer overcoated this region, then the actlve device would be short circuited. Alternatively, the terminal ends of a pair of lines may form the base and emitter contacts of a bipolar transistor. If the titanium silicide layer overcoated the exposed region of the substrate, disposed between these terminal ends, then the transistor would be shorted. Accordingly, the passivating oxide layer is utilized to prevent titanium silicide formation over these active regions.

In the self-aligned titanium silicide process, the entire upper surface of the structure, including the substrate and poly lines, is overcoated with a layer of titanium. A first region of the titanium layer overcoats the passivating oxide layer while a second region overcoats the exposed surfaces of the polycrystalline silicon lines.

Subsequently, the entire structure is sintered in an ambient atmosphere of a selected gas to convert the titanium disposed over the exposed surface of the polysilicon into titanium silicide.

Ideally, the titanium disposed over the passivating oxide layer is not converted into titanium silicide but remains metallic titanium.

Next, the metallic titanium is selectively etched from the structure. Thus, titanium silicide layers with their edges self-aligned to the edges of the passivating oxide layer are formed.

Unfortunately, the ideal titanium to titanium silicide conversion process described above is not realized in practice. During this conversion process, silicon atoms diffuse vertically and laterally into the titanium layer. It is the vertical diffusion which causes the titanium disposed over the exposed surface of the silicon to convert into titanium silicide. However, the lateral diffusion of the silicon atoms also causes titanium silicide to form over the passivating oxide layer. Unless the conversion rate is carefully controlled a titanium silicide layer may be formed over the passivating oxide layer, thereby forming a titanium silicide connection over the passivating oxide layer and shorting out the active device disposed below the passivating layer.

Additionally, silicon oxide itself reacts with the metallic titanium to form various conducting compounds. These compounds are not completely removed from the surface of the oxide during the selective etch process. Thus, leakage currents from either the transistor or the active device diminish the performance of the structure.

Accordingly, new processes are being actively developed to reduce lateral diffusion and prevent the formation of leakage currents.

SUMMARY OF THE INVENTION

The present invention provides a novel method for reducing lateral diffusion of silicon into titanium during the titanium to titanium silicide conversion process and for removing residual conductive material from the surface of the field oxide layer overcoating a silicon substrate.

As described above, in the titanium silicide self-aligned process, a passivating oxide layer is disposed on the exposed surface of either a poly line or monocrystalline layer. The upper surfaces of the silicon and the oxide are overcoated by a titanium layer. The entire structure is then sintered to convert the regions of the titanium layer disposed over exposed silicon into titanium silicide.

In a preferred embodiment of the present invention, the titanium overcoated structure is placed in an airtight chamber and an ambient atmosphere of ultrapure gaseous nitrogen is introduced in the chamber. The structure is then exposed to radiation from Tungsten-halogen lamps to heat the structure to a predetermined temperature for a predetermined time. This heating, or sintering, converts the regions of the titanium layer overcoating the exposed surface of poly or monocrystalline silicon into titanium silicide.

Typically, this sintering process has been performed in an argon gas atmosphere. The reaction time of the titanium to titanium silicide conversion process is extremely fast in the argon ambient thereby precluding control of the rate of the reaction. Consequently, it was impossible to control the rate of titanium silicide formation so that the titanium metal above the exposed regions of silicon could be completely converted while preventing the formation of titanium silicide connections over the passivating oxide layer.

The success of self alignment is dependent on how well the lateral diffusion of silicon is controlled, without sacrificing vertical diffusion for the maximum silicide growth on the exposed silicon regions. The utilization of a nitrogen ambient slows the rate of conversion sufficiently to allow precise control of the rate of conversion. In a nitrogen ambient the rate of reaction increases slowly over a broad temperature range. Thus, the reaction temperature may vary without catastrophically increasing the reaction rate. This slow rate of change is important since temperature control during the reaction is imprecise. Accordingly, a temperature and reaction time may be selected to fully convert the titanium disposed over the exposed silicon while retarding lateral diffusion to prevent the formation of a titanium silicide layer over the passivating oxide layer.

According to one aspect of the invention, approximately 600 Angstroms of titanium is deposited on the structure. Active structures, or gaps on the order of two micrometers, are overcoated by passivating oxide layer. The structure is then heated to a temperature of between about 500° to about 800° Centigrade by exposing the structure to radiation from the tungsten halogen lamp for approximately ten seconds.

According to another aspect of the invention, after the termination of the sintering step described above, unconverted metallic titanium is selectively etched from the surface of the structure. Because the primary goal of the above sintering step was to convert metallic titanium to titanium silicide on the exposed silicon surfaces without forming titanium silicide connections over the passivating oxide regions the conductivity of the titanium silicide layer has not been maximized. Thus, after the selective etching process has been completed the structure is sintered a second time in a nitrogen ambient including a trace of oxygen. This oxygen oxidizes the trace conductive residues left on the oxide surfaces and increases the isolation of the active devices in the structure. It lowers reverse junction leakage currents by two orders of magnitude.

DETAILED DESCRIPTION OF THE PREFERRED EMBODIMENT

The present invention is a method for reducing lateral diffusion of silicon during a titanium silicide self-aligned process and for removing residual conductive traces from the surfaces of the field oxide layers on a structure formed by the process. To better understand the invention, a brief description of a semiconductor structure formed by a titanium silicide self-aligned process and the steps for forming the titanium silicide layer will be presented. Next, the lateral diffusion or "crawl out" problem will be described with reference to FIG. 2. Finally, the process of the present invention will be described with reference to FIGS. 3 and 4.

Figure 1A:
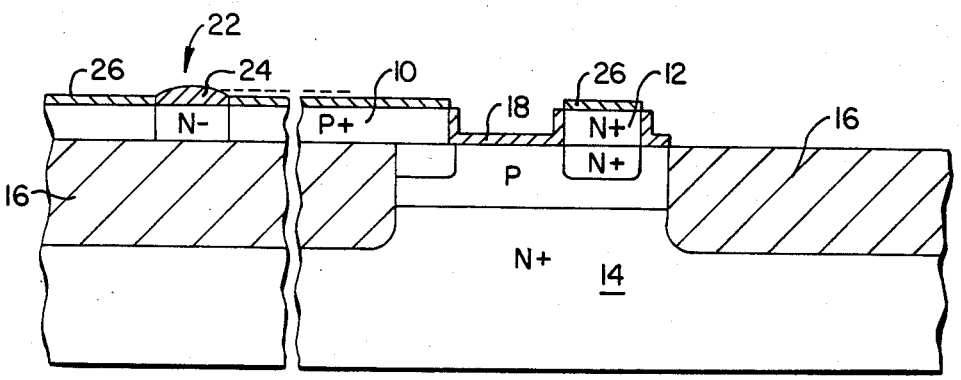
FIGS. 1A and 1B are cross-sectional views of a semiconductor structure having polysilicon lines overcoated with titanium silicide.

Referring now to FIG. 1, a cross-sectional view of a bipolar semiconductor structure utilizing polysilicon contact lines with titanium silicide layers formed thereon to increase the conductivity of the polysilicon lines is presented. In FIG. 1A, the poly lines form base and emitter contacts 10 and 12, respectively, of a bipolar transistor. The emitter contact 12 is an N+ doped polycrystalline silicon line with a terminal end disposed on the exposed surface of a monocrystalline silicon substrate 14. The base contact line 10 is a P+ doped polycrystalline line with a terminal end disposed over the surface of the monocrystalline substrate and with the remainder disposed over the isolation field oxide region 16 of the semiconductor structure. The exposed surface of the silicon substrate 14 positioned between the terminals of the emitter and base contact lines 12 and 10 is overcoated with a passivating oxide layer 18.

The resistor 22 is overcoated by a second passivating layer 24. The surface of the polysilicon lines 10 and 12 not covered by a passivating oxide layer is termed the exposed surface regions while those surfaces covered with a passivating oxide layer 24, for example, the surface of the N− resistor 22, are termed unexposed surface regions. The exposed surface regions of the polysilicon lines 10 and 12 are covered with a titanium silicide layer 26.

Figure 1B:
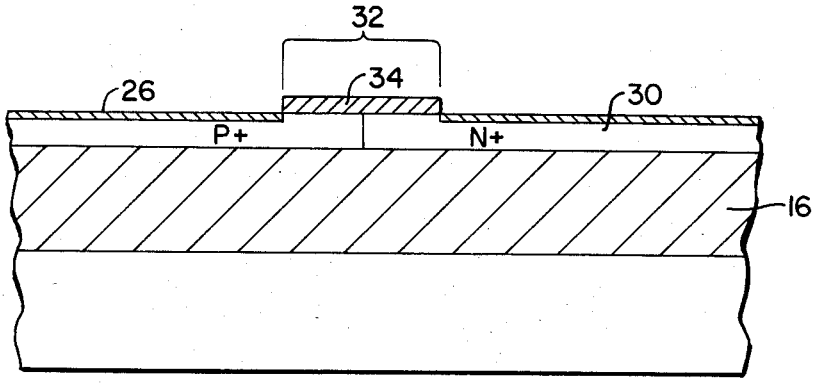

In FIG. 1B another section of the semiconductor structure is depicted. There, a polysilicon line 30 is disposed on the field oxide of the semiconductor structure. A P+/N+ diode 32 is formed in the polysilicon line 30. The diode is overcoated by a third passivating oxide layer 34. The exposed surface of the polysilicon line is overcoated by a titanium silicide layer 26. Two distinct silicon structures are illustrated in FIGS. 1A and 1B. In the first, the passivating oxide layer is disposed over an active device formed in a polysilicon line. In the second, the passivating oxide layer is disposed over the surface region of the monocrystalline substrate positioned in the gap between the terminal ends of two poly lines.

It is the purpose of the passivating oxide layers 18, 24 and 34 to prevent the formation of titanium silicide over the surface of the silicon disposed thereunder.

As depicted in FIGS. 1A and 1B, the titanium silicide layer 26 overcoating the exposed surfaces of the polysilicon lines 10, 12, and 30 is interrupted by passivating oxide layers 18, 24, and 34 disposed over active devices in the semiconductor structure. These interruptions in the titanium silicide layer 26 are critical to the functions of the various active devices. For example, consider the N− resistor 22. If the titanium silicide layer extended across the passivating oxide layer 24 overcoating the resistor 22 then current would flow through the layer 26, thereby short circuiting the resistor 22. The situation for the diode 32 is similar. Further, if the titanium silicide layer extended over the passivating layer 18 disposed over the portion of the silicon substrate 14 positioned in the gap between the terminals of the emitter and base contact lines 10 and 26 these terminals would be shorted, thereby shorting out the transistor.

Figure 2:
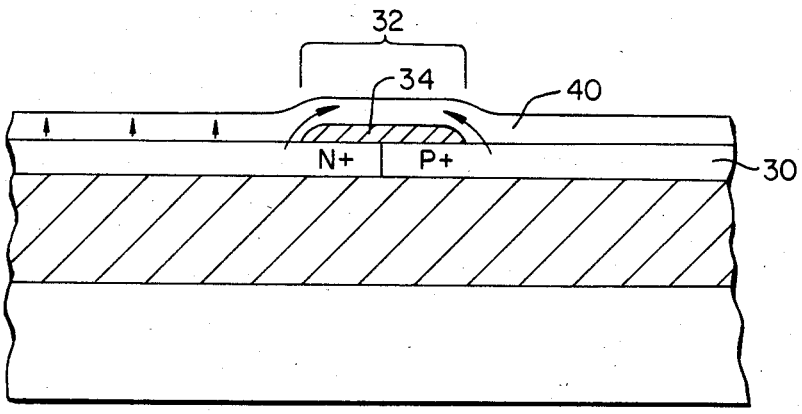
FIG. 2 is a cross-sectional view of an active device in a polysilicon line.

The titanium silicide layers are prevented from forming over the passivating oxide layers 18, 24, and 34 by a self-aligned process. This process will now be described with reference to FIG. 2. In FIG. 2 an intermediate step in the formation of the N+/P+ diode 32 is depicted. The passivating oxide layer 34 overcoating the diode 32 was formed by therma oxidation of a window etched in a silicon nitride layer disposed over the polysilicon line 30. This silicon nitride layer was subsequently removed, leaving all the upper surface of the polysilicon line 30 exposed except for the region under the passivating oxide layer 34. Subsequently, a titanium layer 40 was deposited over the entire structure. This titanium layer 40 is utilized to form the titanium silicide layer overcoating the exposed regions of the polysilicon lines.

The self-alignment of the edges of the titanium silicide layer to the edges of the passivating oxide layer is achieved by the following process. The titanium overcoated structure is sintered by heating the structure to a predetermined temperature for a predetermined time. This heat causes the titanium over the exposed surfaces of the polysilicon line 30 to react with the polysilicon to form titanium silicide. The titanium disposed over the passivating oxide layer 34 is not reacted and remains metallic titanium. Subsequently, the structure is placed in an etching solution, typically $NH_4OH+H_2O_2$ (1:3 by volume), which selectively etches metallic titanium from the surface of the silicon structure. Thus, titanium silicide layers 26 are formed only over the exposed surfaces of the polysilicon line and all conductive material is removed from the surface of the passivating oxide layer 34. Note also that since the titanium layer 40 extends over the entire surface of the structure that this selective etching process also removes conductive material from the surfaces of the field oxide layer 16.

Unfortunately, undesired reactions take place in the above-described sintering process that cause the formation of titanium silicide over the surface of the passivating oxide layer and the formation of other conducting titanium compounds on the exposed surface of the field oxide layer 16.

The titanium silicide formed on the surface of the passivating oxide layer 34 is formed by lateral diffusion of silicon from the exposed surface of the polysilicon line 30. During the sintering process silicon atoms diffuse into the titanium layer 40. It is this diffusion that contributes to the conversion of the titanium into titanium silicide. The reaction must proceed at a predetermined rate for a predetermined time to completely convert the titanium disposed over the exposed regions of the polysilicon line into titanium silicide to maximize the magnitude of the conductivity of the polysilicon line 30. While this vertical diffusion is taking place, silicon atoms are also diffusing laterally into the metallic titanium disposed over the passivating oxide layer 34. If the reaction proceeds for a sufficient period of time the atoms diffusing from opposite sides of the passivating oxide layer will from a titanium silicide layer completely overcoating the passivating oxide layer, thus forming a titanium silicide connection thereover. Accordingly, the rate of reaction and time of reaction must be controlled to complete convert the titanium disposed over the exposed regions while preventing the formation of a titanium silicide connection over the passivating oxide layer 34. This control of the lateral diffusion problem is the most critical factor to the success of the titanium self-alignment process. The method of the present invention provides a good control over the lateral diffusion problem and thereby allows the formation of active devices in the semiconductor structure on the scale of 1–2 microns.

Additionally, metallic titanium reacts with the silicon dioxide itself to form certain ternary conductive titanium compounds. These compounds are not completely removed by the selective etching process, thus leaving conductive residues on the surface of the field oxide regions. These conductive residues cause leakage currents which degrade the performance of the bipolar active devices. Accordingly, means for removing these conductive residues are highly desirable and provided by the present invention.

Figure 3:
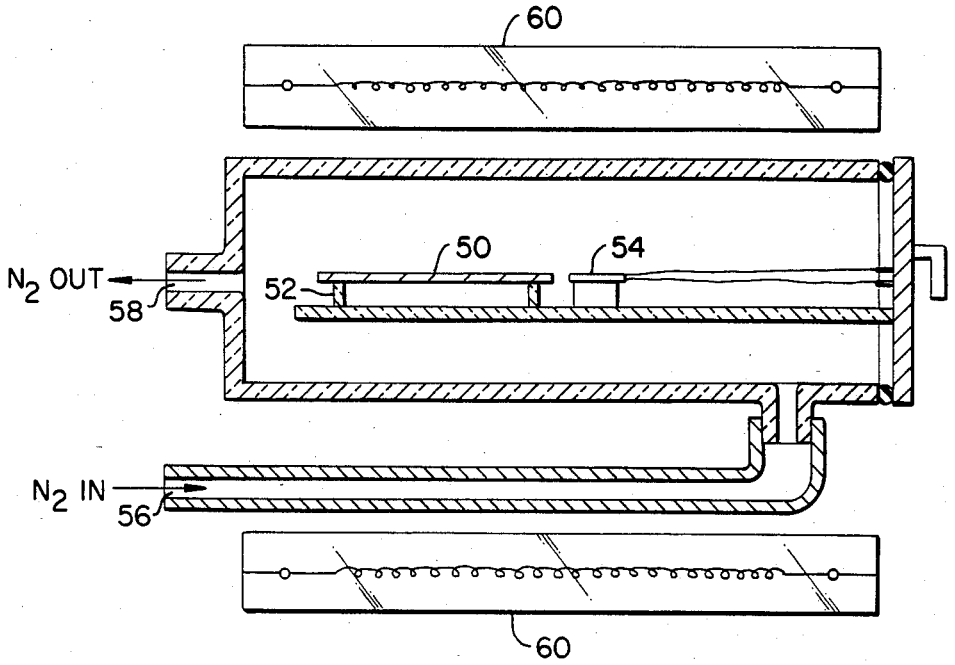
FIG. 3 is a schematic diagram of an apparatus utilized for performing the method of the present invention.

In FIG. 3 the apparatus used for performing the process of the present invention is depicted. The apparatus includes an airtight chamber 50 with a substrate holder 52 disposed therein. The substrate holder 52 includes a thermocouple 54 for measuring the temperature of the substrate. The air chamber includes a gas inlet 56 for introducing selected gases into the chamber and a gas outlet 58 for removing gases from the chamber. Banks of tungsten halogen lamps 60 are utilized to heat a structure mounted on the substrate holder 52.

In practice, a heatpulse 210T manufactured by AG Associates of Palo Alto, Calif. was utilized for performing the process of the invention. In this reactor the structure is exposed to intense radiation from the tungsten halogen lamps 60 for periods of about 10 seconds. In existing processes, the airtight chamber is filled with an ambient atmosphere of argon gas during the heating step.

Figure 4A:
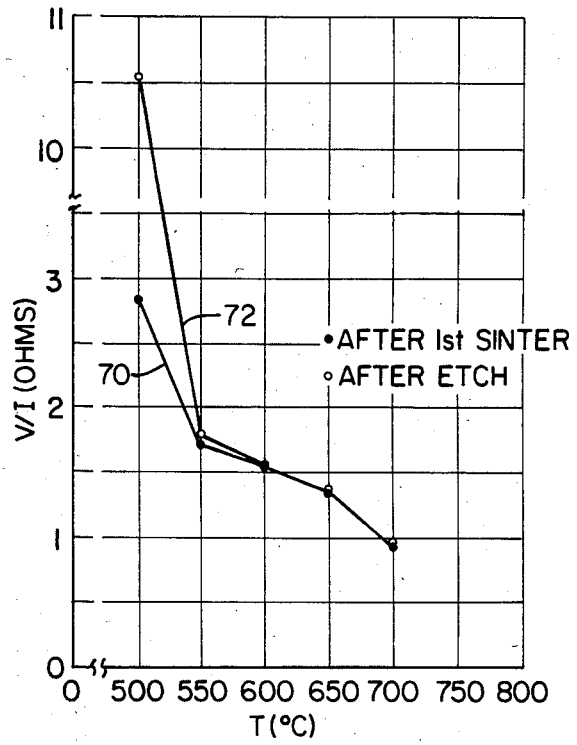
FIGS. 4A and 4B are graphs depicting the titanium to titanium silicide conversion rate in argon and nitrogen ambient atmospheres, respectively.

FIG. 4A is a graph depicting the rate of titanium to titanium silicide conversion for a 600 Angstrom thick titanium layer in an ambient atmosphere of argon. Referring now to FIG. 4A, the temperature of the reaction is given by the position of the line on the X axis while the resistivity in ohms of the silicide is given by the position on the Y axis. A first line 70 depicts the resistivity as a function of temperature after the first sintering step has been completed. A second line 72 depicts the resistivity as a function of the temperature after the first etch has been completed. The difference between these lines 70 and 72 is an indication of the rate at which the conversion of titanium to titanium silicide is progressing.

As described above, metallic titanium is removed in the selective etching step. Thus, if metallic titanium remained after the sintering step were completed, the resistivity would be greater after the selective etch than before the selective etch because the resistivity of metallic titanium is much less than the resistivity of titanium silicide. For example, at 500° C. there is a large difference between the resistivity before and after the selective etch, thus indicating that a large amount of metallic titanium remains unconverted at 500° C. At 550° C. there is little difference in resistivity indicating that the entire thickness of titanium had been converted to titanium silicide. Note that above 550° C. the conversion of titanium to titanium silicide is completed in the 10 second sintering period, thereby indicating an extremely high conversion rate. Note also from the graph that significant control of the conversion rate in an argon ambient may only be achieved in the 500° C. to 550° C. temperature range. Once the temperature of the substrate is above 550° C. the conversion rate is very high and uncontrollable.

As described above with reference to FIG. 2, during the sintering step the diffusion of silicon atoms into the metallic titanium layer proceeds both vertically and laterally. Thus, the rate of reaction determines the time required to convert all the titanium disposed above the exposed surface of the polysilicon line into titanium silicide and also determines the distance over the passivating oxide layer over which titanium silicide will be formed. Since the structure is heated for a period of about 10 seconds the control of the reaction rate is achieved through temperature control. However, due to limitations in existing reaction chambers, precise temperature control is not achievable. Because of the narrow temperature range over which the reaction could be controlled in an argon ambient it was found that significant production problems resulted from shorts due to lateral diffusion or "crawl out" during the fabrication of two micron scale structures. Temperature drifts outside of the 550° C. range caused the titanium to titanium silicide conversion reaction to proceed at such a high rate that titanium silicide connections were formed over the passivating oxide layers.

Figure 4B:
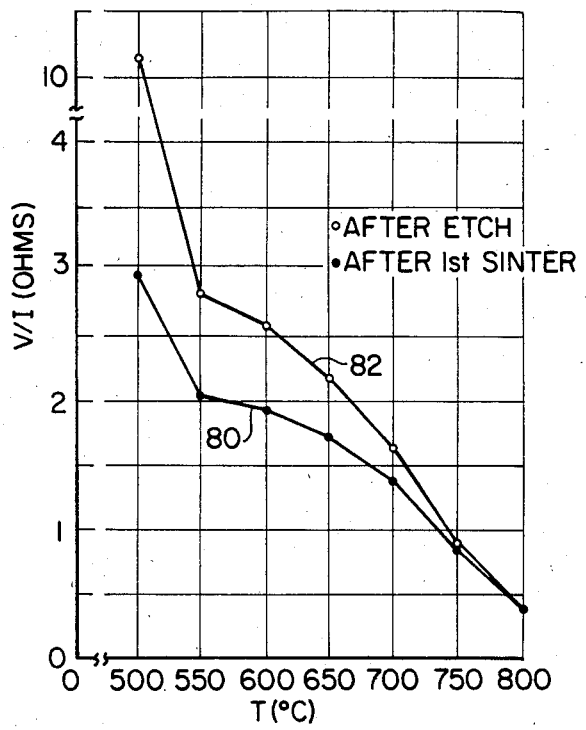

In the present invention, the sintering step is performed in an ambient atmosphere of ultrapure nitrogen ($N_2$). FIG. 4B depicts the resistivity to temperature curves of the silicide for a 600 Angstrom thick metallic titanium layer deposited on the structure. A first line 80 depicts the dependence of the resistivity on temperature after the first sintering step and a second line 82 depicts the dependence of resistivity temperature after the completion of the first etch. From the discussion above relating to FIG. 4A, it is apparent that the reaction proceeds at a controllable rate from a temperature of 500° C. up to a temperature of about 800° C. Thus the temperature range over which the reaction may be controlled is great enough to compensate for the difficulties in obtaining precise temperatures during the reaction process.

Figure 5A:
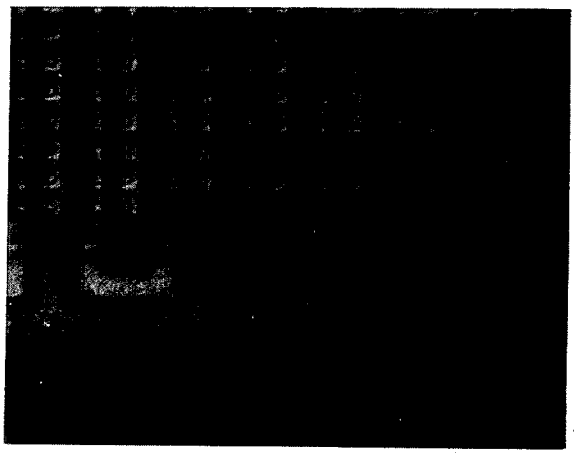
FIGS. 5A and 5B are photographs illustrating the effect of the present invention.
Figure 5B:
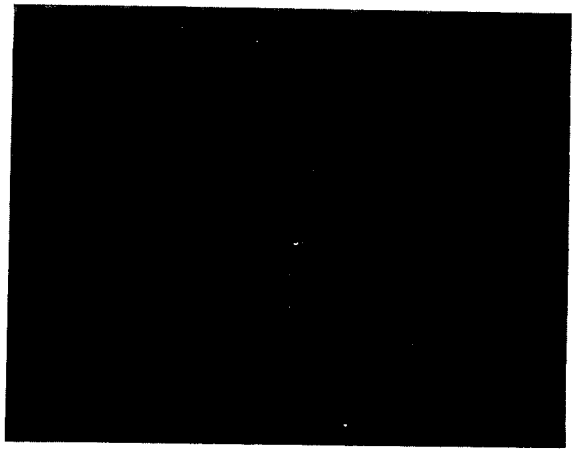

Experimental results indicate that lateral diffusion or "crawl out" problem is substantially reduced utilizing the techniques of the present invention. Referring now to FIGS. 5A and B, an example of the control of lateral diffusion afforded by the present invention is depicted. In FIG. 5A a photograph of titanium silicide overcoated poly lines formed at 800° C. for ten seconds in an $N_2$ ambient is shown. In FIG. 5B the same line structure formed at 800° C. in 10 seconds in an argon ambient is depicted. Note that the structure formed in the argon ambient has greater than 5 microns lateral diffusion or "crawl out" and that all lines are shorted. In contrast, the structure in FIG. 5A shows clean line definition with no lateral diffusion or "crawl out."

As described above, the primary goal of the sintering step is to completely convert the titanium disposed above the exposed polysilicon regions into titanium silicide while preventing the formation of titanium silicide connections over the passivating oxide layers. The subsequent selective etch removes metallic titanium from the surface of the passivating oxide layers, thereby removing the lateral diffusion or "crawl out" problem. The conductivity of the titanium silicide overcoated polysilicon lines is substantially increased by resintering the structure in an $N_2$ ambient, at a higher temperature after the etch.

It was discovered that significant leakage currents developed after the selective etch process had been completed. These leakage currents were attributed to traces of conductive residues formed by interaction of the metallic titanium layer with the surface of the field oxide layer itself. These conductive residues were not removed during the selective etching process. Accordingly, a trace of oxygen was introduced into the ambient atmosphere during the second sintering step to oxidize the conductive residues into nonconductive materials. These magnitude of the above-described leakage currents was found to be significantly reduced after this oxidation step.

The foregoing is a detailed description of a preferred embodiment of the invention. Although specific materials, thicknesses, and processes have been described to illustrate and explain the invention, these details should not be interpreted as limiting the invention, which instead, is defined by the scope of the appended claims.

What is claimed is:

1. A method for forming a titanium silicide layer on the surface of a silicon layer comprising the steps of:

overcoating the surface of the silicon layer with titanium;

placing said overcoated silicon layer in an ambient atmosphere of ultrapure nitrogen; and exposing said overcoated silicon layer to radiation from a tungsten-halogen source to heat said overcoated layer.

2. The method of claim 1 further comprising the step of:

controlling the intensity of said radiation and the time period of said exposure to heat said silicon layer to a predetermined temperature.

3. The method of claim 2 further comprising the steps of:

selecting said period of time to be about 10 seconds;

selecting the thickness of said titanium layer to be about 600 Angstroms; and selecting said predetermined temperature to be in the range of about 500° C. to about 800° C.

4. A method for forming a titanium silicide coating on the exposed surface region of a silicon structure, with the upper surface of the silicon structure being divided into an unexposed region overcoated with a first oxide layer and an exposed region not overcoated with the first oxide layer, and with the exposed region of the silicon structure and the upper surface of said first oxide layer being overcoated with a titanium layer, said method comprising the steps of:

placing said overcoated silicon structure into an airtight chamber;

providing an ambient atmosphere in said airtight chamber of ultrapure, gaseous nitrogen ($N_2$); and sintering said titanium layer by exposing said structure to radiation from a tungsten-halogen source, said radiation being of a predetermined intensity, and said exposure being for a predetermined period of time to form a layer of titanium silicide along the exposed surface of said silicon structure.

5. The method of claim 4 further comprising the step of:

selecting the magnitude of said predetermined intensity and said period of time to fully react the titanium disposed above said exposed surface while preventing lateral diffusion from forming a titanium silicide connection over said oxide layer.

6. The method of claim 5 further comprising the step of:

providing a silicon structure comprising a monocrystalline, silicon substrate, overcoated with a field oxide layer, having a polysilicon line disposed on the surface of said field oxide layer with said first oxide layer disposed on the upper surface of said polysilicon line and with the remaining upper surface of said polysilicon line being said exposed surface.

7. The method of claim 6 further comprising the step of:

positioning said first oxide layer over an active device disposed in said polysilicon line.

8. The method of claim 5 further comprising the step of:

selecting said silicon structure to be a monocrystalline silicon substrate with a pair of polycrystalline silicon (poly) lines with the terminal ends of said poly lines separated by a gap disposed on the upper surface of said monocrystalline substrate.

9. The method of claim 8 further comprising the step of:

positioning said oxide layer in the gap separating said poly lines to cover the upper surface of said substrate positioned in said gap.

10. The method of claim 7 or claim 9 further comprising the step of:

providing an oxide layer with a cross-sectional dimension of about two micrometers.

11. The method of claim 10 further comprising the step of:

selecting said period of time to be about ten seconds.

12. The method of claim 11 further comprising the step of:

selecting the intensity of said radiation to heat said structure to a temperature in the range of about 500° C. to about 800° C.

13. The method of claim 12 further comprising the step of:

selecting the thickness of said oxide layer to be about 600 Angstroms.

14. The method of claim 7 further comprising the step of:

selecting said active device to be a resistor.

15. The method of claim 7 further comprising the step of:

selecting said active device to be a diode.

16. A method for forming a titanium silicide coating on the exposed surface region of a silicon structure, with the upper surface of the silicon structure being divided into an unexposed region overcoated with a first oxide layer or a field oxide layer and an exposed region not overcoated with the first oxide layer or field oxide layer, and with the exposed region of the silicon structure and the upper surface of said first oxide layer being overcoated with a titanium layer, said method comprising the steps of:

placing said overcoated silicon structure in an airtight chamber;

providing an ambient atmosphere in said airtight chamber of ultrapure, gaseous nitrogen ($N_2$);

sintering said titanium layer by exposing said structure to radiation of a predetermined intensity, from a tungsten-halogen source, for a predetermined period of time to form a layer of titanium silicide along the exposed surface of said silicon structure;

selectively etching titanium from the upper surface of said first oxide layer and said field oxide layer;

providing an ambient atmosphere of gaseous nitrogen ($N_2$) including a trace of oxygen ($O_2$);

resintering said structure by reexposing the structure to said radiation to increase the conductivity of the titanium silicide layer formed by said first sintering step and to oxidize trace amounts of conductive material on the surface of said oxide layers to reduce leakage from active devices in said polysilicon line.

17. A method of removing conductive titanium compounds from the surface of a silicon dioxide layer comprising the steps of:

placing said layer in an ambient atmosphere of nitrogen and a trace of oxygen; and exposing said layer to radiation from a tungsten-halogen source to heat said layer.

18. The method of claim 17 further comprising the step of:

controlling said trace of oxygen to be about 0.1% of the ambient atmosphere.

* * * * *